US007339535B2

(12) United States Patent
Liang et al.

(10) Patent No.: US 7,339,535 B2
(45) Date of Patent: Mar. 4, 2008

(54) ELECTRONIC APPARATUS HAVING ANTENNA DEVICE

(75) Inventors: Jia-Haur Liang, Kaohsiung (TW); Ting-Yi Tsai, Taipei (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 11/537,666

(22) Filed: Oct. 2, 2006

(65) Prior Publication Data

US 2007/0085749 A1 Apr. 19, 2007

(30) Foreign Application Priority Data

Oct. 14, 2005 (TW) ..... 94135944 A

(51) Int. Cl.
*H01Q 1/24* (2006.01)

(52) U.S. Cl. ..... 343/702; 343/700 MS; 343/846

(58) Field of Classification Search ..... 343/702, 343/700 MS, 846
See application file for complete search history.

(56) References Cited

U.S. PATENT DOCUMENTS 4,123,756 A * 10/1978 Nagata et al. ..... 343/702
6,266,020 B1 * 7/2001 Chang ..... 343/702
6,891,505 B2 * 5/2005 Kurjenheimo et al. ..... 343/702
7,091,910 B2 * 8/2006 Liang et al. ..... 343/702

* cited by examiner

*Primary Examiner*—Hoang V Nguyen
(74) *Attorney, Agent, or Firm*—Thomas, Kayden, Horstemeyer & Risley

(57) ABSTRACT

An electronic apparatus having an antenna device. The electronic apparatus includes a housing, a circuit board, an antenna device and a feeding device. The circuit board is placed inside the housing. The antenna device disposed on a surface of the housing transmits and receives a wireless signal. The feeding device has one end electrically connected to the circuit board and the other end electrically connected to the antenna device.

18 Claims, 5 Drawing Sheets

ELECTRONIC APPARATUS HAVING ANTENNA DEVICE

This application claims the benefit of Taiwan application Serial No. 94135944, filed Oct. 14, 2005, the subject matter of which is incorporated herein by reference.

BACKGROUND OF THE INVENTION

1. Field of the Invention

The invention relates in general to an electronic apparatus, and more particularly to an electronic apparatus having an antenna disposed on a surface of a housing of the apparatus.

2. Description of the Related Art

FIG. 1 is a schematic illustration showing a structure of a conventional electronic apparatus 10. Referring to FIG. 1, the electronic apparatus 10, such as a mobile telephone, includes a housing 110, a circuit board 120 and an antenna device 130. The circuit board 120 of the conventional electronic apparatus 10 is placed inside the housing 110. The antenna device 130 is mounted to the circuit board 120 to transmit and receive a wireless signal. The antenna device 130 includes, for example, a chip antenna or planar inverted F antenna (PIFA).

The efficiency of the conventional electronic apparatus 10 of receiving and transmitting the wireless signal depends on the antenna gain and the return loss of the antenna device 130. The antenna gain is the ratio of the wireless signal before being transmitted to the wireless signal after being received, and the return loss is the ratio of the wireless signal after return to the wireless signal before return.

However, because the antenna device 130 of the conventional electronic apparatus 10 is mounted to the circuit board 120, the antenna device 130 tends to be interfered with other electronic elements, such as capacitors or transformers, in the circuit board 120, and the antenna gain and the return loss of the antenna device 130 tend to be influenced seriously. In general, the antenna gain of the conventional electronic apparatus 10 is usually a negative value, and the specified value of the return loss is usually less than −7 dB.

In addition, if the antenna device 130 is mounted to the circuit board 120, the available layout space in the circuit board 120 is correspondingly decreased and the layout difficulty of the circuit board 120 is also increased.

SUMMARY OF THE INVENTION

It is therefore an object of the invention to provide an electronic apparatus having an antenna disposed on a surface of a housing of the apparatus. Disposing the antenna device on the surface of the electronic apparatus increases the available layout space in a circuit board and prevents the antenna device from being interfered with other devices on the circuit board.

The invention achieves the above-identified objects by providing an electronic apparatus including a housing, a circuit board, an antenna device and a feeding device. The circuit board is placed inside the housing. The antenna device disposed on a surface of the housing transmits and receives a wireless signal. The feeding device has one end electrically connected to the circuit board and the other end electrically connected to the antenna device.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
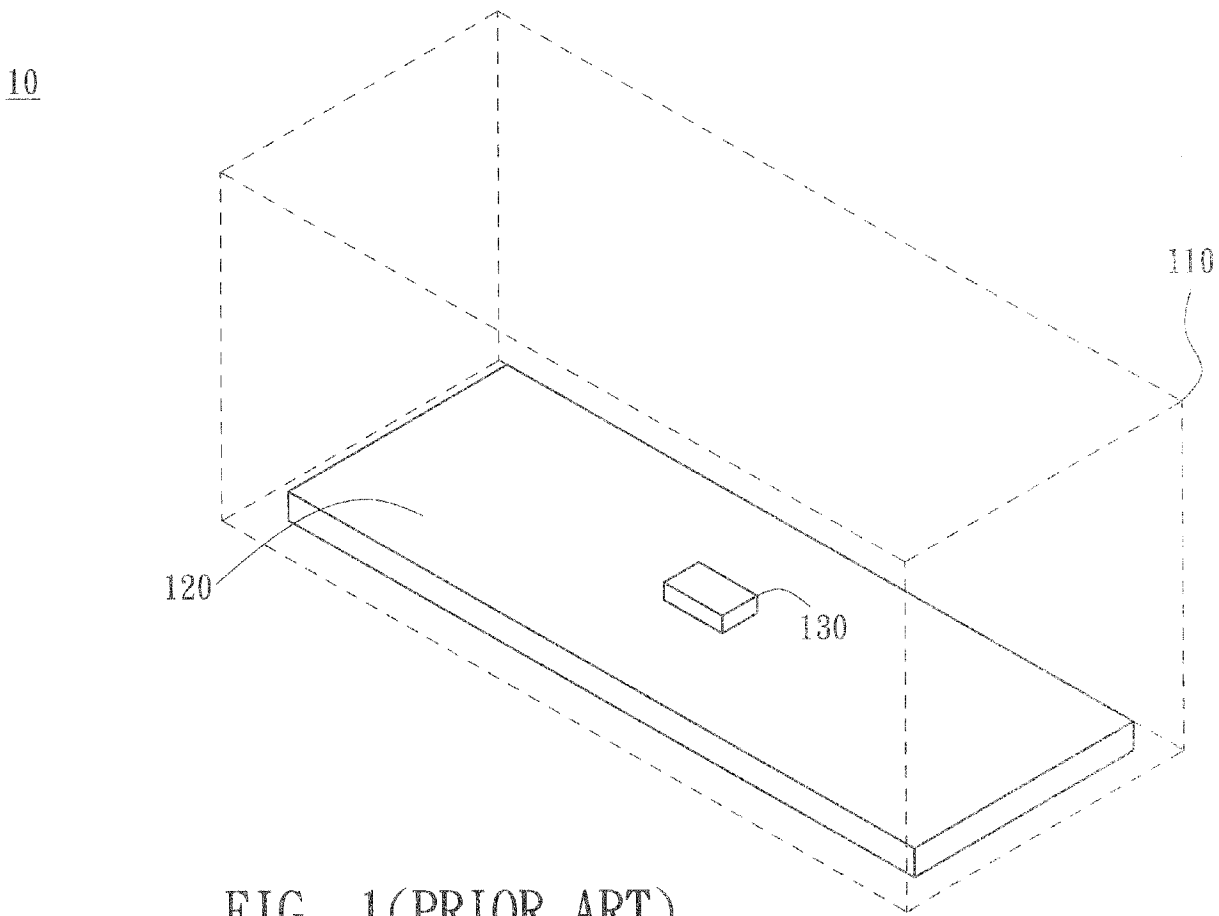
FIG. 1(PRIOR ART)
FIG. 1 (Prior Art) is a schematic illustration showing a structure of a conventional electronic apparatus.
Figure 2:
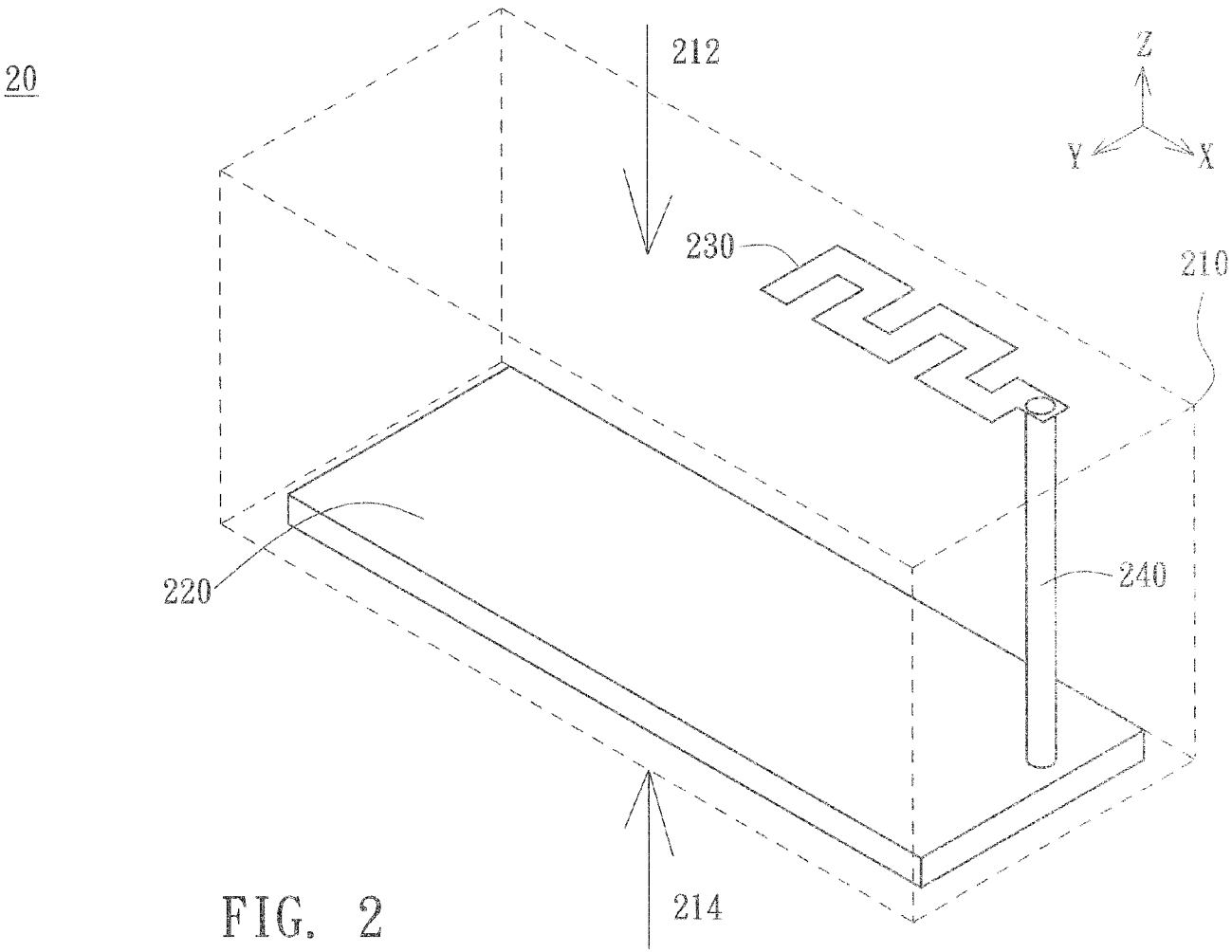
FIG. 2 is a schematic illustration showing a structure of an electronic apparatus according to a preferred embodiment of the invention.

FIG. 2 is a schematic illustration showing a structure of an electronic apparatus 20 according to a preferred embodiment of the invention. Referring to FIG. 2, the electronic apparatus 20, such as a mobile electronic product including a mobile telephone, a mobile disk or a MP3 player, includes a housing 210, a circuit board 220, an antenna device 230 and a feeding device 240. The housing 210 includes an upper surface 212 and a lower surface 214 opposite to the upper surface 212. The circuit board 220 is placed on the internal lower surface 214 of the housing 210, and the antenna device 230 is disposed on the external upper surface 212 of the housing 210. The feeding device 240 may be, for example, a metal rod or a metal wire. Two ends of the feeding device 240 are respectively electrically connected to the circuit board 220 and the antenna device 230 such that the electronic apparatus 20 receives and transmits the wireless signal through the antenna device 230.

For example, the housing 210 is a plastic housing whose size is 3.5 cm×2 cm×2 cm, and the circuit board 220 is a multi-layer circuit board whose size is 3.5 cm×2 cm. One layer of the circuit board 220 is, capable to be design, a ground plane whose size is 3.5 cm×2 cm. The distance from the antenna device 230 to the ground plane of the circuit board 220 substantially equals 2 cm because the antenna device 230 is disposed on the upper surface 212.

Figure 3A:
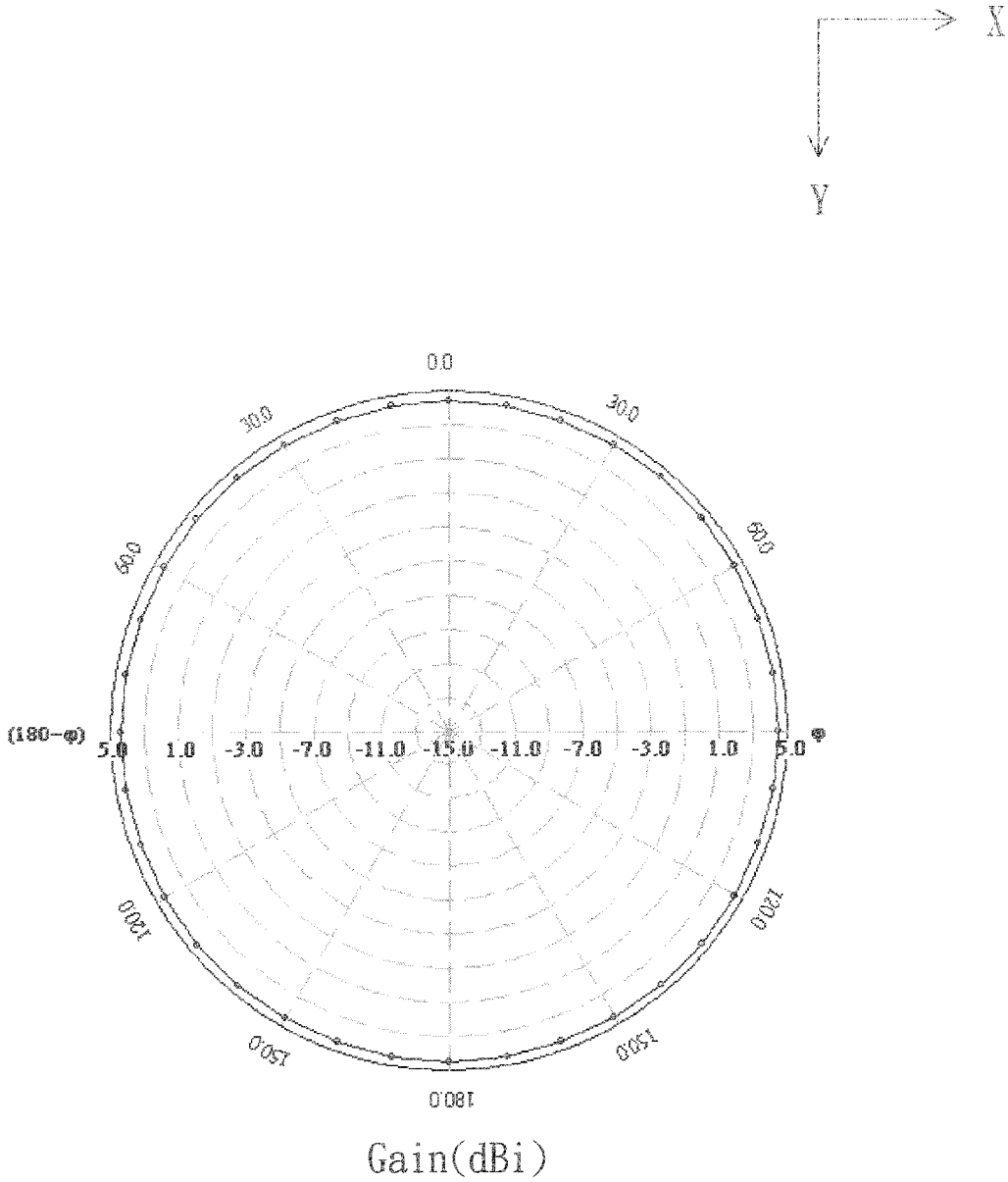
FIGS. 3A and 3B show radiation patterns of the electronic apparatus of FIG. 2.
Figure 3B:
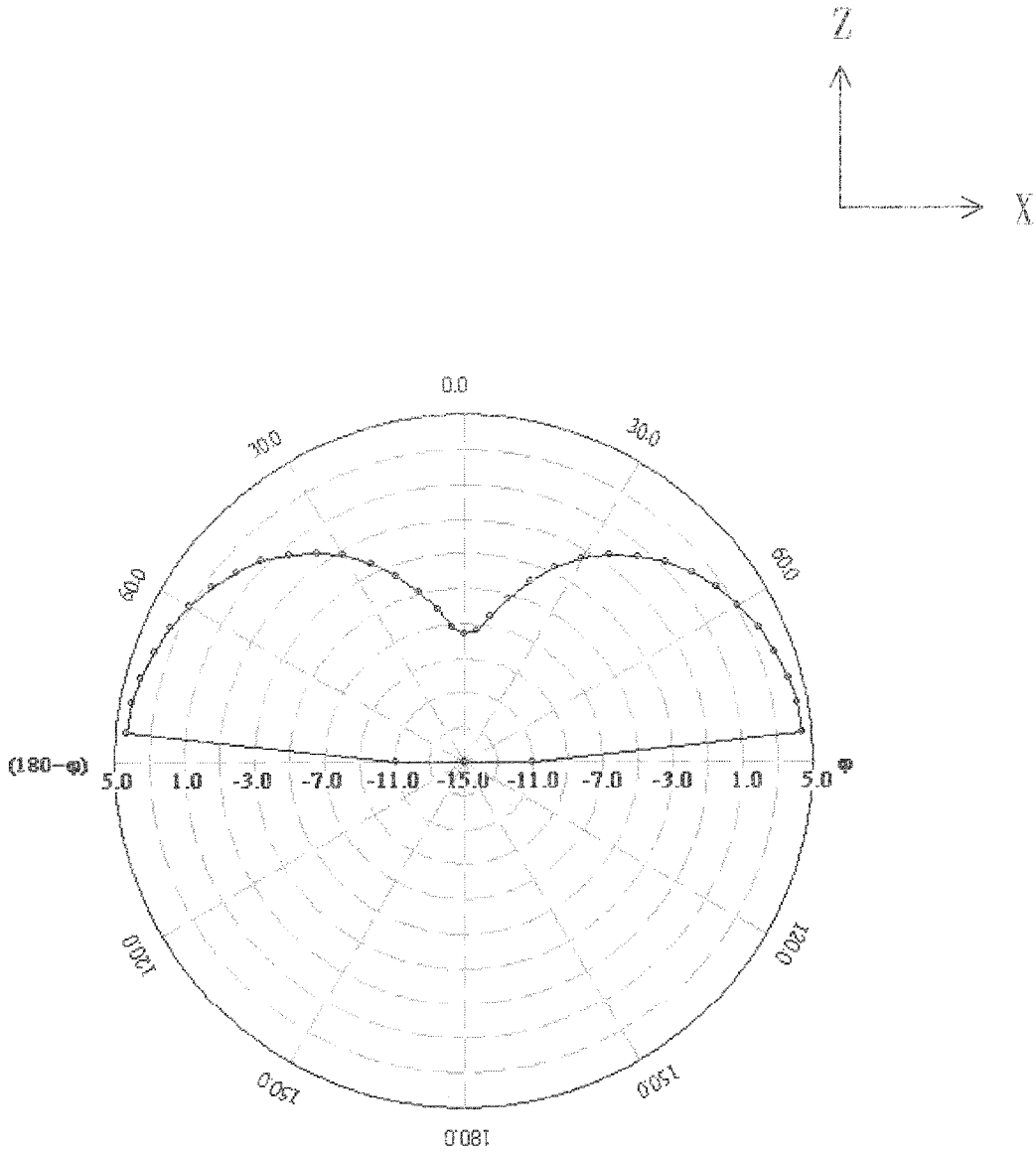
Figure 4:
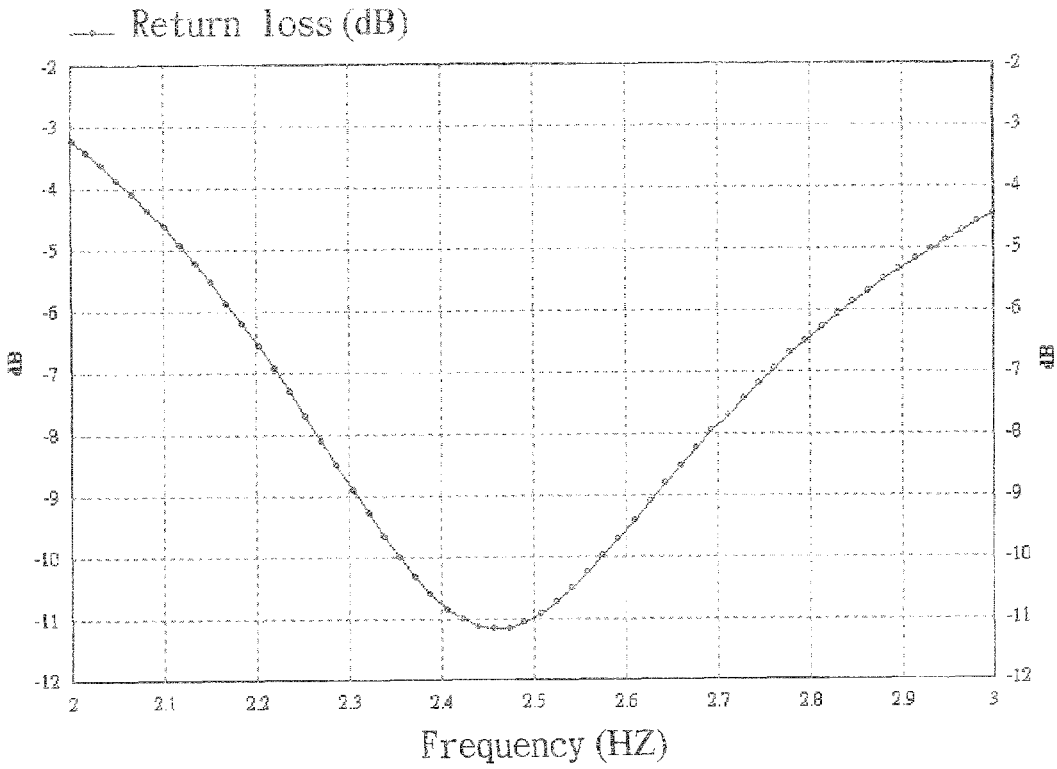
FIG. 4 shows the return loss of the electronic apparatus of FIG. 2.

FIGS. 3A and 3B show radiation patterns of the electronic apparatus of FIG. 2. FIG. 4 shows the return loss of the electronic apparatus 20 of FIG. 2. Referring to FIGS. 3A, 3B and 4, the antenna device 230 is disposed on the upper surface 212 of the electronic apparatus 20. When the distance from the upper surface 212 to the lower surface 214 is greater than $\lambda/4$ ($\lambda$ denotes the wavelength of the wireless signal) and the distance from the antenna device 230 to the circuit board 220 is also greater than $\lambda/4$, the antenna can be free from the interference of other devices on the circuit board 220. At this time, the antenna gain may also be enhanced to 4 dB from the conventional negative value, as shown in FIGS. 3A and 3B, and the specified value of the return loss may be adjusted from the conventional −7 dB to the value below −10 dB, as shown in FIG. 4.

The antenna device 230 may be, for example, a linear polarized antenna or a circular polarized antenna. The antenna device 230 is made of metal and may have various patterns including the patterns of twelve constellations or animal patterns. The antenna device 230 may be plated with a metal layer, such as a gold layer or a silver layer. Alternatively, the antenna device 230 may be covered with a protection film to prevent the device from being scratched, such that the antenna device 230 may have the effects of receiving and transmitting the wireless signal as well as the draping effect.

In addition, the antenna device 230 may also be electrically connected to the feeding device 240 in various ways. For example, the antenna device 230 and the feeding device 240 may be integrally formed, the antenna device 230 may be bonded to one end of the feeding device 240, or one end of the antenna device 230 and one end of the feeding device 240 are fixed together using a screw. Thus, the electronic apparatus 20 can receive and transmit the wireless signal through the antenna device 230.

The electronic apparatus having the antenna device disposed on the surface of the housing according to the embodiment of the invention has the following advantages.

First, the available layout space in the circuit board can be enlarged. Because the antenna device is disposed on the upper surface of the housing, the available layout space in the circuit board is relatively enlarged, and the difficulty of layout on the circuit board can be reduced.

Second, the antenna gain and the return loss are increased. Because the distance from the upper surface to the lower surface is greater than $\lambda/4$, the interference of the circuit board with the antenna device is reduced, and the antenna gain and the return loss are increased.

Third, the maintenance is very convenient. Because the antenna device may be fixed to one end of the feeding device by way of bonding or screwing, the antenna device can be replaced without disassembling the housing of the electronic apparatus such that the maintenance is very convenient.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electronic apparatus, comprising:

a housing comprising an external upper surface and an internal lower surface opposite to the external upper surface;

a circuit board placed inside the housing and disposed on the internal lower surface of the housing, the circuit board comprising a ground plane;

an antenna device, which is disposed on the external upper surface of the housing and is above the ground plane, for transmitting and receiving a wireless signal; and a feeding device having one end electrically connected to the circuit board, and the other end electrically connected to the antenna device;

wherein a distance from the external upper surface on which the antenna device is disposed to the internal lower surface on which the circuit board is disposed is greater than one fourth of a wavelength of the wireless signal so as to reduce interference of the circuit board with the antenna device.

2. The electronic apparatus according to claim 1, wherein the antenna device and the feeding device are integrally formed.

3. The electronic apparatus according to claim 1, wherein the antenna device is bonded to the feeding device.

4. The electronic apparatus according to claim 1, wherein the antenna device is made of metal.

5. The electronic apparatus according to claim 1, wherein the surface of the antenna device is plated with gold.

6. The electronic apparatus according to claim 1, wherein the surface of the antenna device is plated with silver.

7. The electronic apparatus according to claim 1, wherein the feeding device is a metal rod.

8. The electronic apparatus according to claim 1, wherein the feeding device is a metal wire.

9. The electronic apparatus according to claim 1, wherein the antenna device is a circular polarized antenna.

10. The electronic apparatus according to claim 1, wherein the antenna device is a linear polarized antenna.

11. The electronic apparatus according to claim 1, wherein the electronic apparatus is a mobile electronic product.

12. The electronic apparatus according to claim 11, wherein the mobile electronic product is a mobile telephone.

13. The electronic apparatus according to claim 11, wherein the mobile electronic product is a mobile disk.

14. The electronic apparatus according to claim 11, wherein the mobile electronic product is a MP3 player.

15. The electronic apparatus according to claim 1, wherein the housing is a plastic housing whose size is 3.5 cm×2 cm×2 cm.

16. The electronic apparatus according to claim 1, wherein the circuit board is a multi-layer circuit board whose size is 3.5 cm×2 cm.

17. The electronic apparatus according to claim 16, wherein one layer of the multi-layer circuit board is a ground plane whose size is 3.5 cm×2 cm.

18. The electronic apparatus according to claim 17, wherein a distance from the antenna device to the ground plane of the circuit board substantially equals 2 cm.

* * * * *